US012716662B2

(12) United States Patent
Shin et al.

(10) Patent No.: US 12,716,662 B2
(45) Date of Patent: Aug. 25, 2026

(54) COMPOSITE COATING FILM, HEAT EXCHANGER COMPRISING SAME, AND METHOD FOR MANUFACTURING HEAT EXCHANGER

(71) Applicant: LG ELECTRONICS INC., Seoul (KR)

(72) Inventors: Subeen Shin, Seoul (KR); Younghwan Ko, Seoul (KR); Hae Seung Lee, Seoul (KR); Yeongpin Chu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 191 days.

(21) Appl. No.: 18/835,857

(22) PCT Filed: Feb. 3, 2023

(86) PCT No.: PCT/KR2023/001568

§ 371 (c)(1),
(2) Date: Aug. 5, 2024

(87) PCT Pub. No.: WO2023/149742

PCT Pub. Date: Aug. 10, 2023

(65) Prior Publication Data

US 2025/0155207 A1 May 15, 2025

(30) Foreign Application Priority Data

Feb. 3, 2022 (KR) ..... 10-2022-0014018

(51) Int. Cl.
*F28F 13/18* (2006.01)
*F28F 19/04* (2006.01)

(52) U.S. Cl.
CPC ..... *F28F 13/182* (2013.01); *F28F 19/04* (2013.01); *F28F 2245/02* (2013.01)

(58) Field of Classification Search
CPC ..... F28F 13/182; F28F 13/18; F28F 19/02; F28F 19/04; F28F 2245/00; F28F 2245/02
See application file for complete search history.

(56) References Cited

U.S. PATENT DOCUMENTS 4,421,789 A * 12/1983 Kaneko ..... C25D 11/18 427/409
5,137,067 A * 8/1992 Espeut ..... F28F 19/04 165/133

(Continued)

FOREIGN PATENT DOCUMENTS

JP 2001-247822 9/2001
JP 2001-323250 11/2001

(Continued)

OTHER PUBLICATIONS

International Search Report (with English Translation) dated Apr. 27, 2023 issued in Application No. PCT/KR2023/001568.

*Primary Examiner* — Travis Ruby
(74) *Attorney, Agent, or Firm* — KED & ASSOCIATES, LLP

(57) ABSTRACT

The present disclosure relates to a complex coating film, and a fin and tube type heat exchanger and a microchannel type heat exchanger comprising the same. The complex coating film in the present disclosure comprises a metallic material; a first coating layer being formed on the metallic material; and a second coating layer being formed on the first coating layer, wherein the first coating layer comprises 10-40 wt % of a first hydrophilic resin, 1-20 wt % of a metal compound, 5-20 wt % of an amide-based cross linker, 1-15 wt % of a silane compound and water as a remaining component, and the second coating layer comprises 1-20 wt % of a second hydrophilic resin, 1-20 wt % of a silica particle, 0.01-5 wt % of a cross linker, 0.1-5 wt % of a solvent, and water as a (Continued)

remaining component, providing long-lasting corrosion resistance and hydrophilicity to the complex coating film.

20 Claims, 8 Drawing Sheets

(56) References Cited

U.S. PATENT DOCUMENTS

| | | | | |
|---|---|---|---|---|
| 6,571,864 | B1 * | 6/2003 | Yoon | F28F 13/18 165/133 |
| 6,869,677 | B1 * | 3/2005 | Uehara | C23C 22/83 428/340 |
| 7,493,941 | B2 * | 2/2009 | Kawasaki | F28F 19/04 165/134.1 |
| 7,927,707 | B2 * | 4/2011 | Kawasaki | C23C 28/00 428/457 |
| 9,139,913 | B2 * | 9/2015 | Matsui | B23K 1/203 |
| 11,583,601 | B2 * | 2/2023 | Donoshita | A61K 9/50 |
| 2003/0037914 | A1 * | 2/2003 | Inbe | C08L 71/02 165/905 |
| 2008/0063895 | A1 * | 3/2008 | Jun | C23C 16/30 428/650 |
| 2011/0180249 | A1 * | 7/2011 | Yoshida | C09D 7/62 165/185 |
| 2019/0032972 | A1 * | 1/2019 | Seko | F25B 39/02 |
| 2022/0259443 | A1 * | 8/2022 | Huang | C01B 33/146 |

FOREIGN PATENT DOCUMENTS

| | | |
|---|---|---|
| JP | 2019-113250 | 7/2019 |
| JP | 2021-116993 | 8/2021 |
| KR | 10-0469382 | 1/2005 |
| KR | 10-2010-0103940 | 9/2010 |
| KR | 10-1463050 | 11/2014 |
| KR | 10-2016-0071548 | 6/2016 |
| KR | 10-2020-0006436 | 1/2020 |
| KR | 10-2020-0038477 | 4/2020 |

* cited by examiner (a) (b) (c)

(a) (b)

COMPOSITE COATING FILM, HEAT EXCHANGER COMPRISING SAME, AND METHOD FOR MANUFACTURING HEAT EXCHANGER

CROSS-REFERENCE TO RELATED PATENT APPLICATIONS

This application is a U.S. National Stage Application under 35 U.S.C. § 371 of PCT Application No. PCT/KR2023/001568, filed Feb. 3, 2023, which claims priority to Korean Patent Application No. 10-2022-0014018, filed Feb. 3, 2022, whose entire disclosures are hereby incorporated by reference.

TECHNICAL FIELD

The present disclosure relates to a complex coating film comprising a first coating layer providing corrosion resistance and hydrophilicity to a fin or a tube of a heat exchanger for a heat exchange, and a second coating layer having hydrophilicity and being formed on the first coating layer to ensure long-lasting hydrophilicity and corrosion resistance, and a fin and tube type heat exchanger and a microchannel type heat exchanger comprising the same.

BACKGROUND ART

A heat exchange system is provided in an appliance that operates based on a basic mechanism of heat exchange. For example, appliances such as an air conditioner, a refrigerator, a dehumidifier and the like achieve aims based on a heat exchange and is categorized into an appliance provided with the heat exchange system.

A typical device of the heat exchange system is a heat exchanger. In the case where the heat exchanger continues to operate, moisture is formed on the surface of the heat exchanger. For example, in the case where the heat exchanger is used as an evaporator of an air conditioner, temperature of the evaporator becomes lower than room temperature in a cooling mode of the air conditioner. Accordingly, condensate is formed on the surface of the evaporator.

In the case where the heat exchanger is used for cooling in summer, temperature of the surface of an aluminum fin is a dew point of the atmosphere or less, and water droplets are attached to the surface of the fin. As water droplets are attached to the surface of the fin, three problems can be caused as follows. First, the aluminum fin becomes vulnerable to corrosion. Second, ventilation resistance increases, and an air amount decreases, resulting in deterioration in heat exchange efficiency. Third, the water droplets on the surface of the fin is suctioned into cooling air, and scattered to an indoor space or the inside of a vehicle.

In the case where a fin has a hydrophilic surface, water attached to the surface of the fin is shaped into a water curtain rather than a sphere. To solve the above problem, a hydrophilic film is ordinarily formed on the surface of a fin material. Additionally, to prevent corrosion, an corrosion resistant film is provided between the fin material and the hydrophilic film.

As a related art, a "heat exchange system" is disclosed in KR Patent Publication No. 10-2020-0006436 published on Jan. 20, 2020, and comprises a formation layer and a hydrophilic coating layer.

However, according to the document, the formation layer and the hydrophilic coating layer are formed in an area where moisture stays on the surface of a basic material for a long time, to provide an antibacterial function and an odor removing function of the heat exchange system, producing no significant corrosion resistance effect.

Further, a "material comprising a super hydrophobic surface and a manufacturing method thereof" is disclosed in KR Patent No. 10-1463050 published on Nov. 18, 2014, and involves providing super hydrophobicity to the surface of aluminum metal by coating a titanium dioxide layer with a compound containing fluorine.

However, according to the document, three or more layers containing a polydopamine coating layer, a titanium dioxide layer, a layer of a compound containing fluorine and the like need to be formed on the surface of a material, making processing complex, and it is doubtful whether the coating layers are reliably maintained in an outdoor heat exchanger in an environment where there is a big difference in temperature.

DESCRIPTION OF INVENTION

Technical Problems

One objective of the present disclosure is to provide a complex coating film in which a first coating layer having hydrophilicity and corrosion resistance and a second coating layer having hydrophilicity are formed on a metallic material, to ensure long-lasting hydrophilicity and corrosion resistance.

Another objective of the present disclosure is to provide a fin and tube type heat exchanger in which a complex coating layer comprising a first coating layer of hydrophilicity and corrosion resistance and a second coating layer of hydrophilicity is formed, to improve its hydrophilicity and corrosion resistance and promote the effect of draining condensate of the heat exchanger.

Another objective of the present disclosure is to provide a manufacturing method of a fin and tube type heat exchanger in which a complex coating layer comprising a first coating layer of hydrophilicity and corrosion resistance and a second coating layer of hydrophilicity is formed, to improve its hydrophilicity and corrosion resistance and promote the effect of draining condensate of the heat exchanger.

Another objective of the present disclosure is to provide a microchannel type heat exchanger in which a complex coating layer comprising a first coating layer of hydrophilicity and corrosion resistance and a second coating layer of hydrophilicity is formed, to improve its hydrophilicity and corrosion resistance and promote the effect of draining condensate of the microchannel type heat exchanger.

Another objective of the present disclosure is to provide a manufacturing method of a microchannel type heat exchanger in which a complex coating layer comprising a first coating layer of hydrophilicity and corrosion resistance and a second coating layer of hydrophilicity is formed, to improve its hydrophilicity and corrosion resistance and promote the effect of draining condensate of the microchannel type heat exchanger.

Yet another objective of the present disclosure is to provide an indoor unit and an outdoor unit of an air conditioner in which a complex coating layer comprising a first coating layer of hydrophilicity and corrosion resistance and a second coating layer of hydrophilicity is formed, to improve its hydrophilicity and corrosion resistance and promote the effect of draining condensate of the indoor unit of the air conditioner.

Aspects according to the present disclosure are not limited to the above ones, and other aspects and advantages that are not mentioned above can be clearly understood from the following description and can be more clearly understood from the embodiments set forth herein. Additionally, understandably, the aspects and advantages in the present disclosure are embodied via means and combinations thereof that are described in the appended claims.

Technical Solutions

In the present disclosure, to achieve the above objectives, provided is a complex coating film in which a first coating layer is formed on the surface of a metallic material, and a second coating layer is formed on the first coating layer, to additionally form a hydrophilic layer as well as providing corrosion resistance and hydrophilicity to a coating composition, thereby maintaining the hydrophilicity of the complex coating film and improving drainage of condensate at a maximum level.

Specifically, the first coating layer comprises a first hydrophilic resin, a metal compound, an amide-based cross linker and a silane compound. The first hydrophilic resin provides hydrophilicity to the coating film, the metal compound provides corrosion resistance to the coating film, the silane compound improves a coupling force with a metallic material, and the amide-based cross liker improves the durability of the first hydrophilic resin providing hydrophilicity to the coating film and the durability of the coating layers.

Additionally, the second coating layer comprises a second hydrophilic resin, a silica particle, a cross linker and a solvent. The second hydrophilic resin provides hydrophilicity to the coating film, the silica particle forms an irregular structure and additionally improves hydrophilicity, the cross linker improves a coupling force between the second hydrophilic resin and the silica particle, and the solvent improves the dispersity of silica.

Specifically, in the complex coating film, the first coating layer comprises 10-40 wt % of a first hydrophilic resin, 1-20 wt % of a metal compound, 5-20 wt % of an amide-based cross linker, 1-15 wt % of a silane compound and water as a remaining component.

The second coating layer comprises 1-20 wt % of a second hydrophilic resin, 1-20 wt % of a silica particle, 0.01-5 wt % of a cross linker, 0.1-5 wt % of a solvent, and water as a remaining component.

In the complex coating film of the present disclosure, a coating amount of the first coating layer and the second coating layer is 0.50-1.50 g/m$^2$.

A fin and tube type heat exchanger in the present disclosure comprises a distribution header distributing refrigerants; a plurality of refrigerant pipes connecting to a lateral surface of the distribution header; and a fin being provided with a hole through which the refrigerant pipe passes and providing a space in which refrigerants moving along the refrigerant pipe and external air exchange heat with each other, wherein the fin has a complex coating film comprising a first coating layer that has corrosion resistance and hydrophilicity, and a second coating layer that has hydrophilicity and is formed on the first coating layer, on a surface thereof, the first coating layer comprises 10-40 wt % of a first hydrophilic resin, 1-20 wt % of a metal compound, 5-20 wt % of an amide-based cross linker, 1-15 wt % of a silane compound and water as a remaining component, and the second coating layer comprises 1-20 wt % of a second hydrophilic resin, 1-20 wt % of a silica particle, 0.01-5 wt % of a cross linker, 0.1-5 wt % of a solvent, and water as a remaining component.

Additionally, a manufacturing method of a fin and tube type heat exchanger in the present disclosure comprises performing roll coating and heat drying on a metallic material and forming a first coating layer; performing roll coating and heat drying on the first coating layer and forming a second coating layer; and manufacturing the metallic material on which the first coating layer and the second coating layer are formed into a plurality of fins, inserting a tube into the fin and manufacturing a heat exchanger.

A microchannel type heat exchanger in the present disclosure comprises a plurality of flat tubes having a plurality of flow paths therein; a fin connecting the flat tubes and transferring heat; and a complex coating film being formed at one or more of the flat tube and the fin, wherein the complex coating film comprises a first coating layer of corrosion resistance and hydrophilicity, and a second coating layer of hydrophilicity, the first coating layer comprises 10-40 wt % of a first hydrophilic resin, 1-20 wt % of a metal compound, 5-20 wt % of an amide-based cross linker, 1-15 wt % of a silane compound and water as a remaining component, and the second coating layer comprises 1-20 wt % of a second hydrophilic resin, 1-20 wt % of a silica particle, 0.01-5 wt % of a cross linker, 0.1-5 wt % of a solvent, and water as a remaining component.

A manufacturing method of a microchannel type heat exchanger in the present disclosure comprises dipping a microchannel type heat exchanger in a coating composition of corrosion resistance and hydrophilicity and forming a first coating layer; immersing the microchannel type heat exchanger at which the first coating layer is formed in a coating composition of hydrophilicity and forming a second coating layer; air blowing a lower end portion of the microchannel type heat exchanger; and drying the microchannel type heat exchanger.

An indoor unit and an outdoor unit of an air conditioner in the present disclosure comprises a cabinet assembly having an inlet into which indoor air is suctioned; a heat exchange assembly being placed in the cabinet assembly and allowing suctioned indoor air and refrigerants to exchange heat, wherein the heat exchange assembly comprises a first microchannel type heat exchanger, a second microchannel type heat exchanger being staked at an upper side of the first heat exchanger, and a support being disposed between the first heat exchanger and the second heat exchanger, integrally coupling the first heat exchanger and the second heat exchanger and supporting the second heat exchanger, the heat exchange assembly comprises a complex coating film being formed at one or more of a flat tube and a fin of the first heat exchanger or the second heat exchanger, the complex coating film comprises a first coating layer of corrosion resistance and hydrophilicity and a second coating layer of hydrophilicity, the first coating layer comprises 10-40 wt % of a first hydrophilic resin, 1-20 wt % of a metal compound, 5-20 wt % of an amide-based cross linker, 1-15 wt % of a silane compound and water as a remaining component, and the second coating layer comprises 1-20 wt % of a second hydrophilic resin, 1-20 wt % of a silica particle, 0.01-5 wt % of a cross linker, 0.1-5 wt % of a solvent, and water as a remaining component.

Advantageous Effects

The complex coating film of the present disclosure comprises a first coating layer of corrosion resistance and hydrophilicity and a second coating layer of hydrophilicity, maintaining the corrosion resistance and hydrophilicity of the complex coating film for a long period of time and improving the performance and lifespan of a product.

In the complex coating film of the present disclosure, the first coating layer of corrosion resistance and hydrophilicity comprises two or more sorts of metal compounds exhibiting corrosion resistance, thereby improving corrosion resistance, and comprises a silane compound, thereby improving a coupling force with metal and being applicable to a variety of metallic materials.

Further, curing temperature of a coating is 240±10° C. within a coating amount range of the corrosion resistant and hydrophilic coating film, thereby expanding a range of temperatures of processing control by about 10° C. compared to conventional processing, and decreasing a mid range temperature of processing control by about 10° C. compared to conventional processing to improve processability.

Specific effects are described along with the above-described effects in the section of detailed description.

DETAILED DESCRIPTION OF EXEMPLARY EMBODIMENTS

Figure 1:
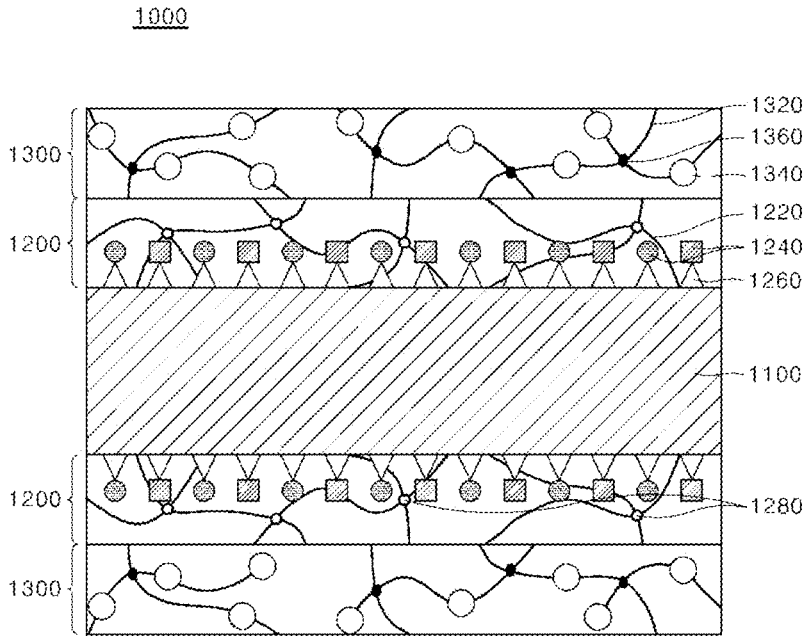
FIG. 1 is a cross-sectional view showing a complex coating film in the present disclosure.

The above-described aspects, features and advantages are specifically described hereafter with reference to accompanying drawings such that one having ordinary skill in the art to which the present disclosure pertains can embody the technical idea of the disclosure easily. In the disclosure, detailed description of known technologies in relation to the subject matter of the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components are not to be limited by the terms. Certainly, a first component can be a second component, unless stated to the contrary.

Throughout the disclosure, each component can be provided a single one or a plurality of ones, unless stated to the contrary.

In the disclosure, the singular forms "a", "an" and "the" are intended to include the plural forms as well, unless explicitly indicated otherwise. In the disclosure, the terms "comprise" or "include" and the like, set forth herein, are not interpreted as necessarily including all the stated components or steps but can be interpreted as excluding some of the stated components or steps or can be interpreted as including additional components or steps.

Hereafter, a complex coating film of the present disclosure, a fin and tube type heat exchanger comprising the same, and a microchannel type heat exchanger comprising the same are described.

In the present disclosure, a complex coating film, comprising: a metallic material;

a first coating layer being formed on the metallic material; and a second coating layer being formed on the first coating layer.

The first coating layer comprises 10-40 wt % of a first hydrophilic resin, 1-20 wt % of a metal compound, 5-20 wt % of an amide-based cross linker, 1-15 wt % of a saline compound, and water as a remaining component.

The second coating layer provides a complex coating film that comprises 1-20 wt % of a second hydrophilic resin, 1-20 wt % of a silica particle, 0.01-5 wt % of a cross linker, 0.1-5 wt % of a solvent, and water as a remaining component.

The content of the components included in the complex coating film of the present disclosure is within a range of weight in a liquid phase of the components, which is a phase prior to the drying of a composition. The composition of each of the components included in the complex coating film is determined based on coupling energy among the components, and as the content of a cross linker, a hydrophilic agent, and a corrosion resistant agent increases in the order of the cross linker, the hydrophilic agent, and the corrosion resistant agent, coupling energy is high.

Specifically, the components of the complex coating film of the present disclosure have unique coupling energy, depending on their chemical structure, and as coupling energy increases, a coupling force increases. To ensure a sufficient coupling force of the complex coating film, the cross linker needs to be included with the highest content, followed by the hydrophilic agent and the corrosion resistant agent.

As a result, to determine the content of each of the components of the complex coating film, the coupling energy of the components included in the complex coating film is calculated, and an optimal content of the components is determined.

Additionally, to ensure the mass productivity of the coating film, a composition used to manufacture the complex coating film needs to have a proper viscosity of at least 20 cPs. A low viscosity is likely to fail to achieve uniform coating and ensure a proper coating amount.

Further, in the case where the temperature of the surface of an aluminum fin disposed at a heat exchanger is the dew point of the atmosphere or less, droplets are attached to the surface of the fin, causing the corrosion of the fin, an increase in stack loss, and a decrease in an air amount. Thus, heat exchange efficiency deteriorates, and the droplets on the surface of the fin is suctioned into cooling air and scattered to an indoor space or into a vehicle.

To solve the above problem, a hydrophilic film is usually formed on the surface of the fin material, and for corrosion resistance, a corrosion resistant film is provided between the fin material and the hydrophilic film. As described above, two-stage coating processes including a process of forming a hydrophilic coating film and a process of forming a corrosion resistant coating film are performed in a related art.

In the above-described related art, the corrosion resistant film and the hydrophilic film are formed respectively, and in particular, the corrosion resistant coating film does not exhibit hydrophilicity, causing deterioration in long-term hydrophilicity and corrosion resistance and reducing the performance and lifespan of a product.

The complex coating film of the present disclosure comprises a first coating layer having corrosion resistance and hydrophilicity, and a second coating layer having hydrophilicity, maintaining the corrosion resistance and hydrophilicity of the complex coating film for a long period of time and ensuring improvement in the performance and lifespan of a product.

That is, in the complex coating film of the present disclosure, the corrosion resistance of the complex coating film may be maintained thanks to the corrosion resistance of the first coating layer, even if the second coating layer is reduced by condensate, a strong coupling between the first coating layer and the second coating layer may be maintained thanks to the first hydrophilic resin of the first coating layer, thereby preventing the second coating layer from being washed away by condensate.

Additionally, in the complex coating film of the present disclosure, the first coating layer having corrosion resistance and hydrophilicity comprises two or more sorts of metal compounds exhibiting corrosion resistance and ensures improvement in corrosion resistance, and comprises a silane compound and has a strong coupling force with metal, and is applicable to a variety of metallic materials.

Further, in the complex coating film of the present disclosure, the first coating layer having corrosion resistance comprises silica and has an irregular structure, thereby improving hydrophilicity further.

Further, the coating amount of each of the first coating layer and the second coating layer is within a range of 0.50-1.50 g/m$^2$, and the curing temperature of each of the first coating layer and the second coating layer is 240±10° C. Accordingly, a range of temperatures of processing control may expand further than that of conventional processing control by about 10° C., and a mid range temperature of processing control may decrease by about 10° C. to improve processability.

In the case where the coating amount is less than 0.50 g/m$^2$, hydrophilicity hardly improves, and corrosion resistance decreases due to a small amount of the metal compound, causing the corrosion of a heat exchanger. Accordingly, by-products produced due to the corrosion of the heat exchanger are likely to be discharged outward at a time of operating an air conditioner, and in the case where the coating amount is greater than 1.50 g/m$^2$, the coupling force with the metallic material decreases, and the coated surface of the heat exchanger may be removed from the surface of the heat exchanger easily.

The metallic material may be aluminum, copper, stainless steel, nickel and the like.

At this time, the first hydrophilic resin of the first coating layer may comprise one or more functional groups among an acryl group, an amide group and a carboxyl group, and 10-40 wt % of the first hydrophilic resin may be preferably included.

In the present disclosure, content denotes wt %, and for example, is based on total content in a composition forming the first coating layer and total content in a composition forming the second coating layer. Additionally, since the first coating layer and the second coating layer are in the state where water evaporates from each of the coating compositions, the content of each component may vary when the coating layers are formed.

In the case where less than 10 wt % of the first hydrophilic resin is included, hydrophilicity on the coating film is insignificant and hydrophilic performance deteriorates, and in the case where greater than 40 wt % of the first hydrophilic resin is included, the content of the metal compound is less than that of a cross linker, and corrosion resistance deteriorates.

In the complex coating film of the present disclosure, the metal compound is added to apply corrosion resistance to the complex coating film, and preferably, comprises at least two or more sorts of metal elements among chromium (Cr), zirconium (Zr) and titanium (Ti), and more preferably, zirconium (Zr) or titanium (Ti) is included in chromium (Cr).

At this time, since vanadium (V), among elements of a metal compound that is usually used, has a unique smell, vanadium (V) is likely to give off its smell at a time of operating an air conditioner and preferably, is not included.

Preferably, 1-20 wt % of the metal compound is added. In the case where less than 1 wt % of the metal compound is included, bondability between a metallic material and a coating material deteriorates, causing the separation of a coating film, and in the case where greater than 20 wt % of the metal compound is included, the content of the first hydrophilic resin decreases, causing deterioration in the hydrophilicity of a coating film.

The amide-based cross linker is included to improve the durability of an acrylic resin applying hydrophilicity on a coating film and a coating film, and 5~20 wt % of the amide-based cross linker is added preferably.

In the case where less than 5 wt % of the amide-based cross linker is added, a coupling force between a hydrophilic component and a corrosion resistant component decreases, and hydrophilicity is hardly maintained for a long period of time. In the case where greater than 20 wt % of the amide-based cross linker is included, durability hardly improves compared to the amount of the added amide-based cross linker, and the curing properties of a coating composition are enhanced causing the coating composition to be hardened.

The amide-based cross linker may be formamide, sodiumamide, nicotinic acid amide, dimethylformamide, acetamide, acrylamide, polyacrylamide, potassiumamide, oxamide, lithiumdiethylamide, dimethylformamide, benzamide, iodoacetamide, acetamide, arylamide, phenylacetamide, cyanoacetamide, dicyanoacetamide, dimethylacetamide, diethylchloroacetamide, dimethylformamide, glycinamide, isopropylacrylamide, methaacrylamide, methylenebisacrylamide, nicotinamide, oleamide, oxamide, sulfanilamide/sulfonilamide and thioacetamide.

The silane compound may be used to improve a coupling force with the metallic material, and have an epoxy functional group.

The silane compound having an epoxy functional group may be 3-glycidoxypropyltrimethoxysilane, chlorotrimethylsilane, 4-(chloromethyl) pentyltrichlorosilane, dichlorodimethylsilane, dichloromethylsilane, dichloromethylpenylsilane, dimethyldichlorosilane, ethoxytrimethylsilane, methyltrimethoxysilane, 3-methacryloxypropyltrimethoxysilane, pentyltrichlorosilane, tetramethylsilane, vinyltriethoxysilane, triethoxyvinylsilane, vinyltrimethylsilane, tetraethoxysilane, and methyltrimethoxysilane and the like, for example.

Preferably, 1-15 wt % of the silane compound is included. In the case where less than 1 wt % of the silane compound is added, a coupling force between a metal compound and a metallic material deteriorates, the durability of a coating film deteriorates, and the possibility of the separation of a coating film increases, and in the case where greater than 15 wt % of the silane compound is added, the content of a hydrophilic component and a corrosion resistant component decreases, and the hydrophilicity and corrosion resistance of a coating film deteriorates.

In the complex coating film of the present disclosure, a second hydrophilic resin of the second coating layer may be used to exhibit hydrophilicity, and may have at least one or more sorts of function groups among a hydroxyl group, an amide group and a carboxyl group.

Preferably, 1-20 wt % of the second hydrophilic resin is included. In the case where less than 1 wt % of the second hydrophilic resin is included, hydrophilicity deteriorates, and the content of silica particles is higher than the content of the second hydrophilic resin, generating silica particles that are not coupled with the hydrophilic resin and degrading dispersibility of the silica particles. In the case where greater than 20 wt % of the second hydrophilic resin is included, the content of hydrophilic particles is much higher than the content of silica particles, and an irregular structure formed by the silica particles decreases, degrading the Wenzel effect that is a hydrophilicity improvement mechanism based on an irregular structure, and decreasing hydrophilicity.

The silica particles are included to improve the hydrophilicity of the second coating layer further, and the size of the silica particles is preferably 1-100 nm, and more preferably, 10-20 nm. In the case where the size of the silica particles is less than 1 nm, the height of the irregularities of the irregular structure formed by the silica particles is low, degrading hydrophilicity and antibacterial performance, and in the case where the size of the silica particles is greater than 100 nm, the particles can be massed in coating, and an even coating cannot be ensured.

Preferably, 1-20 wt % of the silica particles is included. In the case where less than 1 wt % of the silica particles is included, sufficient hydrophilicity may not be ensured, and in the case where greater than 20 wt % of the silica particles is included, the content of the second hydrophilic resin is lower than the content of the silica particles, causing deterioration in the synergy effect of the hydrophilic resin and the silica particles.

The cross linker is used to couple the second hydrophilic resin and the silica particles. The second hydrophilic resin surrounds the silica particles to form a coating.

Specifically, the cross linker is a coupling cross linker and used to couple the second hydrophilic resin and the silica particles, and the second hydrophilic resin surrounds the silica particles to form a coating. That is, the cross linker is a material having two different reaction groups, and one side of the material is comprised of a methoxy group, an ethoxy group, an acetoxy group, an amino group, and an alkoxy group such as an epoxy group and the like, while the other side of the material is comprised of an organic functional group that is coupled to a polymer, such that interfacial adhesiveness of an organic material and an inorganic adhesive increases, ensuring improvement in the properties of a complex material.

The cross linker is a metal coupling cross linker that is a compound where multivalent metal such as aluminum, iron, zinc, tin, titanium, antimony, and magnesium is coordinated with acetyl acetone or ethyl acetoacetate nad the like.

Preferably, 0.01-5 wt % of the cross linker is included. In the case where less than 0.01 wt % of the cross linker is included, a coupling force between the second hydrophilic resin and the silica particles may deteriorate, and in the case where greater than 5 wt % of the cross linker is included, coupling cross linkers that does not react and remain may affect the hydrophilicity and durability of a coating layer adversely.

The solvent is an alcohol-based solvent that can evaporate and improve the dispersity of silica after a composition for forming a coating layer dries, and the alcohol-based solvent may comprise one or more sorts selected from a group that consists of methanol, ethanol, n-propanol, isopropanol, n-butanol, isobutanol, methoxy methanol, ethoxy methanol, methoxy propanol, ethoxy propanol, and diacetone alcohol.

Preferably, 0.1-5 wt % f the solvent is included. In the case where less than 0.1 wt % of the solvent is included, the dispersity of the silica particles deteriorates, the uniformity of a coating layer deteriorates, and the viscosity of coating itself for a coating layer increases, forming a coating layer that is too thick, and in the case where greater than 5 wt % of the solvent is included, the content of the silica particles in coating for a coating layer decreases, causing a small irregular structure.

FIG. 1 is a cross-sectional view showing a complex coating film in the present disclosure. Referring to FIG. 1, a complex coating film 1000 comprises a metallic material 1100, a first coating layer 1200 formed on the metallic material 1100, and a second coating layer 1300 formed on the first coating layer 1200.

The first coating layer 1200 comprises a first hydrophilic resin 1220, a metal compound 1240, a silane compound 1260, an amide-based cross linker 1280.

Two sorts of the metal compound 1240 exhibiting corrosion resistance are included, and the metal compound 1240 comprises the silane compound 1260 to improve a coupling force with the metallic material 1100. Since the silane compound 1260 exhibits a strong coupling force with metal, the metallic material 1100 that can be coated with the silane compound 1260 may comprise other metals including aluminum. Additionally, since the complex coating film comprises the first hydrophilic resin 1220 exhibiting hydrophilicity, the cross linker 1280 having an amide group is included to cure the first hydrophilic resin 1220 and to be coupled with a corrosion resisting agent.

The second coating layer 1300 comprises a second hydrophilic resin 1320, a silica particle 1340 and a cross linker 1360.

The cross linker 1360 is included to couple the second hydrophilic resin 1320 exhibiting hydrophilicity and the silica particle 1340. The second coating layer 1300 may be coupled to the first coating layer 1200 by the amide-based cross linker in the first coating layer 1200.

The second coating layer 1300 may further comprise an additive such as an antibacterial agent to prevent a smell and a bacterial growth and the like.

The first coating layer 1200 and the second coating layer 1300 may comprise a coating stabilizer or a coating preservative to store a coating composition for a long period of time.

A degreasing process may be performed to ensure an adhesive force with the metallic material 1100, before a corrosion resistant and hydrophilic coating film in the present disclosure is formed.

The complex coating film 1000 in the present disclosure may be applied to a fin of a heat exchanger, to allow heat exchange between air of a refrigerant pipe and air around the fin, and a plurality may be provided to enhance heat exchange.

Additionally, a fin and tube type heat exchanger of the present disclosure comprises: a distribution header distributing refrigerants;

- a plurality of refrigerant pipes connecting to a lateral surface of the distribution header; and
- a fin being provided with a hole through which the refrigerant pipe passes, and providing a space in which refrigerants moving along the refrigerant pipe exchange heat with external air,
- wherein a complex coating film comprising a first coating layer that has corrosion resistance and hydrophilicity, and a second coating layer that is formed on the first coating layer and has hydrophilicity is on the surface of the fin,
- the first coating layer comprises 10-40 wt % of a first hydrophilic resin, 1-20 wt % of a metal compound, 5-20 wt % of an amide-based cross linker, 1-15 wt % of a silane compound and water as a remaining component, and
- the second coating layer comprises 1-20 wt % of a second hydrophilic resin, 1-20 wt % of a silica particle, 0.01-5 wt % of a cross linker, 0.1-5 wt % of a solvent and water as a remaining component.

Figure 2:
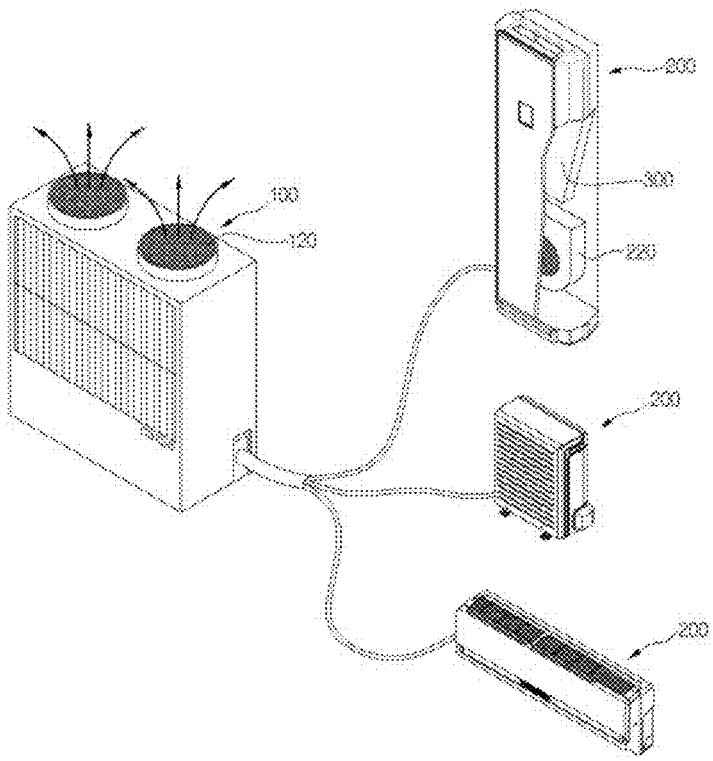
FIG. 2 is a schematic view showing the configuration of an air conditioner.

FIG. 2 is a view showing the configuration of an air conditioner.

A standing air conditioner or a ceiling-mounted air conditioner in the drawing is described an air conditioner, for example. However, the sort of the air conditioner is not restricted to the above-described ones, and a wall-mounted air conditioner or an integrated air conditioner in which an outdoor unit and an indoor unit do not separate can be included. Additionally, the shape of the air conditioner is not restricted to the shape in the drawing.

Referring to FIG. 2, the air conditioner comprises an indoor unit 200 discharging conditioned air to an indoor space, and an outdoor unit 100 connecting to the indoor unit 200 and being disposed in an outdoor space.

The outdoor unit 100 and the indoor unit 200 connect to a refrigerant pipe such that low-temperature air is discharged from the indoor unit 200 to an indoor space, based on the circulation of refrigerants. A plurality of indoor units 200 may be provided and connect to the outdoor unit 100.

Additionally, the air conditioner comprises a plurality of indoor units 200 and at least one outdoor unit 100 connecting to the plurality of indoor units 200. The plurality of indoor units 200 and the outdoor unit 100 connect to a refrigerant pipe, or connect to a communicable cable to transmit or receive a control instruction, based on a predetermined communication method.

The indoor unit 200 comprises a discharge opening that discharges heat exchanged air. The discharge opening may be provided with an air direction adjuster that can open and close the discharge opening and control a direction of air discharged. Additionally, the indoor unit 200 may adjust an amount of air discharged from the discharge opening. At this time, a plurality of air inlets and a plurality of air outlets may have a plurality of vanes. The vane may open and close at least any one of the plurality of air inlets and the plurality of air outlets, and guide a flow direction of air.

Further, the indoor unit 200 may further comprise a display part that displays an operation state and setting information of the indoor unit 200, and an input part that is used to input setting data. As the user inputs an instruction for operating the air conditioner through the input part, the outdoor unit 100 may operate in a cooling mode or a heating mode, in response to the input instruction. Furthermore, the outdoor unit 100 may supply refrigerants to the plurality of indoor units 100, and the flow direction of air is guided along the discharge opening of the indoor unit 100 to adjust the environment of an indoor space.

Figure 3:
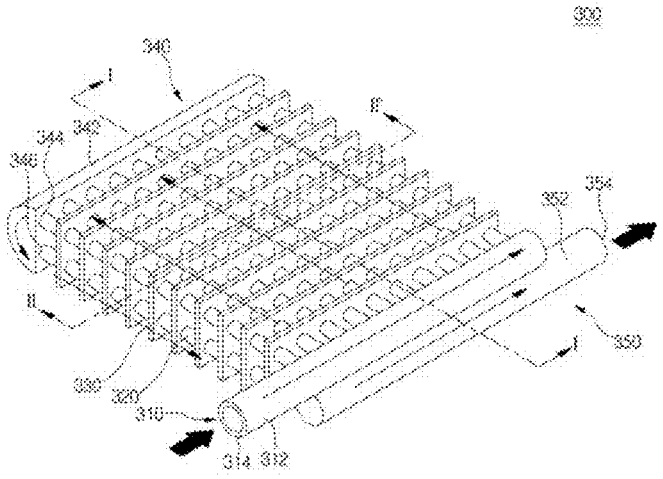
FIG. 3 is a perspective view showing a fin and tube type heat exchanger in the present disclosure.
Figure 4:
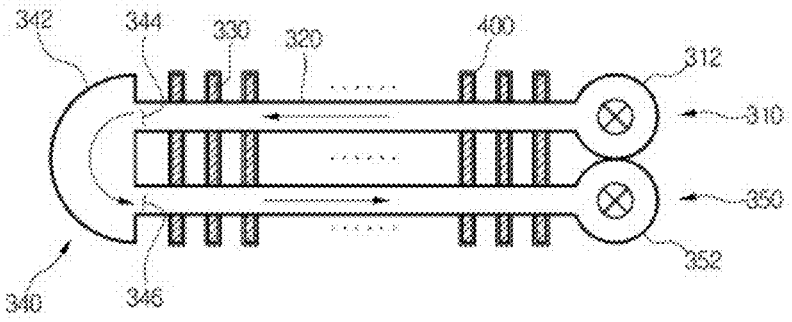
FIG. 4 is a cross-sectional view showing a portion cut along I-I' in FIG. 3.

FIG. 3 is a perspective view showing a fin and tube type heat exchanger in the present disclosure, and FIG. 4 is a cross-sectional view showing a portion cut along I-I' in FIG. 3.

Referring to FIGS. 3 and 4, the fin and tube type heat exchanger 300 in one embodiment may comprise a distribution header 310 that distributes refrigerants flowing into the fin and tube type heat exchanger 300, at least one or more refrigerant pipes 320 that communicates with the distribution header 310, at least one or more fins 330 that are formed at one side of the refrigerant pipe 320, and a discharge header 350 that guides refrigerants discharged from the fin and tube type heat exchanger 300.

The distribution header 310 may comprise a distribution pipe 312 that forms the outer shape of the distribution header 310, and an inflow part 314 that is formed in the end portion of the distribution pipe 312.

The distribution pipe 312 may be a cylindrical pipe that has a hollow hole therein. The shape of the distribution pipe 312 is not restricted to a cylindrical shape. The distribution pipe 312 may be disposed horizontally with respect the ground surface. In other words, the distribution pipe 312 may be disposed perpendicularly with respect to the gravitational direction.

The inflow part 314 may be defined as a portion to which the distribution pipe 312 connects. The inflow part 314 is a portion that guides refrigerants to the fin and tube type heat exchanger 300.

The refrigerant pipe 320 guides refrigerants drawn from the distribution pipe 312 to the discharge header 350. Refrigerants passing through the refrigerant pipe 320 may exchange heat with air flowing in a direction across the refrigerant pipe 320. The refrigerant pipe 320 may be disposed horizontally with respect to the ground surface. In other words, the refrigerant pipe 320 may be disposed perpendicularly in the gravitational direction. The refrigerant pipe 320 may connect to the distribution pipe 312 in a direction perpendicular to the lengthwise direction of the distribution pipe 312.

Additionally, a plurality of refrigerant pipes 320 may be formed. The plurality of refrigerant pipes 320 may be disposed side by side on one surface. In other words, the plurality of refrigerant pipes 320 may be disposed to form one layer.

The refrigerant pipe 320 may comprise a first refrigerant pipe, and a second refrigerant pipe provided at the lower side of the first refrigerant pipe. The first refrigerant pipe may draw refrigerants from the distribution header 310 and discharge the refrigerants to the second refrigerant pipe. The refrigerants drawn into the second refrigerant pipe may pass through the second refrigerant pipe and be guided to the discharge header 350. At this time, a redistribution header 340 may be provided between the first refrigerant pipe and the second refrigerant pipe and allow the first refrigerant pipe and the second refrigerant pipe to communicate.

The redistribution header 340 may comprise a redistribution pipe 342, a first connection hole 344 being formed on the lateral surface of the redistribution pipe 342 and connecting to the first refrigerant pipe, and a second connection hole 346 being formed on the lateral surface of the redistribution pipe 342 and connecting to the second refrigerant pipe.

The redistribution pipe 342 draws refrigerants drawn from the first refrigerant pipe, and discharges the drawn refrigerants to the second refrigerant pipe. The redistribution pipe 342 may have a hollow hole therein, and have a semicircular cross section. However, the shape of the redistribution pipe 342 is not restricted to a semicircular one.

The redistribution pipe 342 may be disposed horizontally with respect to the ground surface. In other words, the redistribution pipe 342 may be disposed perpendicularly with respect to the gravitational direction. The redistribution pipe 342 and the distribution pipe 314 may be disposed in parallel. In other words, the distribution pipe 314 and the redistribution pipe 342 may be disposed in parallel with each other, and the refrigerant pipe 320 may be disposed between the distribution pipe 314 and the redistribution pipe 342. The redistribution pipe 342 may be disposed in a way that the redistribution pipe 342 is orthogonal to the refrigerant pipe 320.

However, the refrigerant pipe 320 may be disposed in two layers in the present disclosure, but not restricted. The refrigerant pipe 320 may be disposed in three layers. At this time, a plurality of the redistribution headers 340 may be disposed in response to the number of layers of the refrigerant pipe 320. Detailed description in relation to this is omitted.

Additionally, the discharge header 350 may comprise a discharge pipe 352 forming the outer shape of the discharge header 350, and a discharge part 354 formed in the end portion of the discharge pipe 352.

The fin 330 may be shaped into a planar heat conductor. The fin 330 may be disposed in a way that the fin 330 is perpendicular to the refrigerant pipe 320. The fin 330 may contact the refrigerant pipe 320, to improve heat transfer efficiency of the refrigerant pipe 320. The fin 330 may have a pipe insertion hole through which the refrigerant pipe 320 is inserted. In other words, the refrigerant pipe 320 may be disposed to penetrate the fin 330.

A flow path of air passing through the fin and tube type heat exchanger 300 is described as follows.

Air having passed through an indoor fan 221 may move to the fin and tube type heat exchanger 300. Specifically, the air having passed through the indoor fan 221 may move to a space formed among the plurality of fins 330. The air having moved to the space may exchange heat with refrigerants moving along the refrigerant pipe 320.

In the winter, frost may be formed on the outer surface of the plurality of fins 330. That is, refrigerants moving along the refrigerant pipe 320 and air being moved by the indoor fan 221 may have a different temperature. Additionally, a difference between the temperature of the refrigerants and the temperature of the air may increase further in the winter.

The complex coating film 400 of the present disclosure may be formed at the fin 330. The coating film 400 may surround the outer surface of the fin 330 entirely. That is, the coating film 400 may also be formed in the edge portion of the fin 330.

A coating film 400 formed in the edge portion of the fin 330 and a coating film 400 formed on one surface of the fin 330 may be respectively manufactured and then coupled, or may be manufactured integrally to surround the outer surface of the fin 330.

Since the coating film 400 surrounds the outer surface of the fin 330, the coating film 400 may prevent the fin 330 from directly contacting external air. Accordingly, frosting caused by frost that is made on the outer surface of the fin 330 may be minimized. That is, frosting on the outer surface of the fin 330 may be delayed.

Further, the coating film 400 may be applied to an outdoor unit. In the case where the coating film 400 is applied to an outdoor unit, drainage improves and frosting is delayed.

Figure 5:
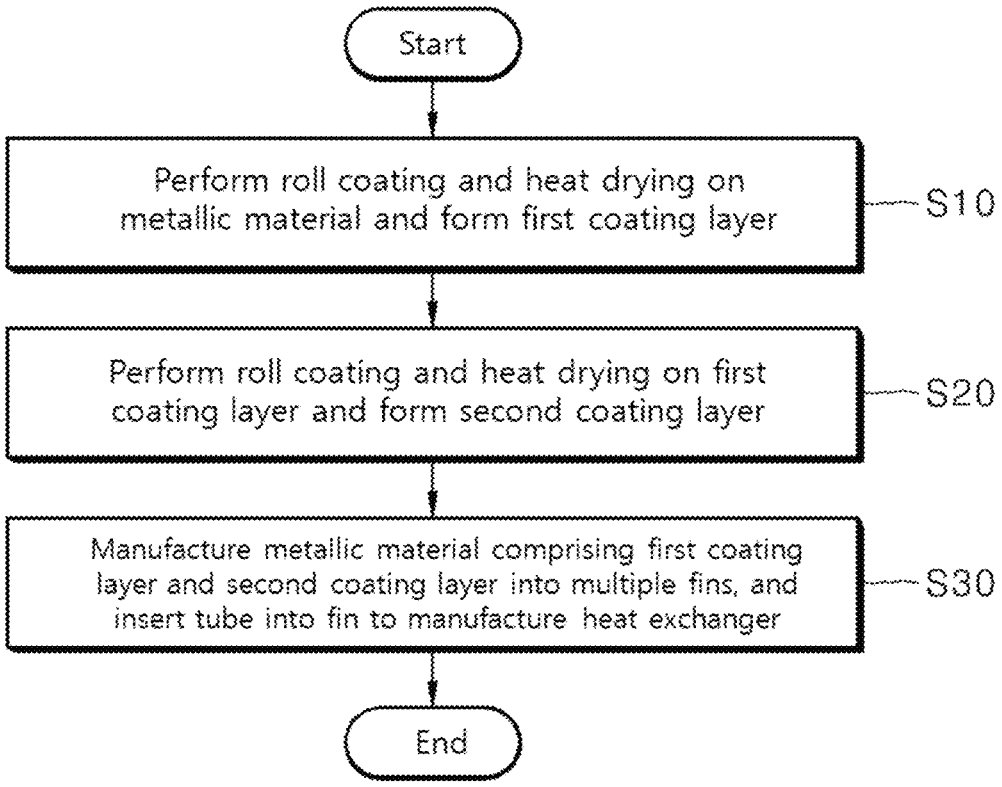
FIG. 5 is a flowchart showing a manufacturing method of a fin and tube type heat exchanger in the present disclosure.

FIG. 5 is a flowchart showing a manufacturing method of a fin and tube type heat exchanger in the present disclosure.

The manufacturing method of a fin and tube type heat exchanger in the present disclosure comprises: performing roll coating and heat drying on a metallic material and forming a first coating layer (S10);

performing roll coating and heat drying on the first coating layer and forming a second coating layer (S20); and manufacturing the metallic material, on which the first coating layer and the second coating layer are formed, into a plurality of fins, inserting a tube into the plurality of fins, and forming a heat exchanger (S30).

The manufacturing method of a fin and tube type heat exchanger in the present disclosure comprises: performing roll coating and heat drying on a metallic material and forming a first coating layer (S10).

The metallic material may be aluminum, copper, stainless steel, nickel and the like.

The roll coating process involves applying coating for forming a coating layer to the upper end and the lower end of the metallic material by a roller, while the roller rotates, and the first coating layer is formed based on roll coating described above.

The first coating layer is a layer having corrosion resistance and hydrophilicity, and as described above, comprises 10-40 wt % of a first hydrophilic resin, 1-20 wt % of a metal compound, 5-20 wt % of an amide-based cross linker, 1-15 wt % of a silane compound, and water as a remaining component.

The drying process is preferably performed at 200-400° C. In the case where temperature of the drying process is less than 200° C., the first coating layer is not formed, and in the case where temperature of the drying process is greater than 400° C., desired corrosion resistance and hydrophilicity may not be embodied.

The manufacturing method of a fin and tube type heat exchanger in the present disclosure comprises performing roll coating and heat drying on the first coating layer and forming a second coating layer (S20).

The second coating layer is a layer having hydrophilicity, and as described above, comprises 1-20 wt % of a second hydrophilic resin, 1-20 wt % of a silica particle, 0.01-5 wt % of a cross linker, 0.1-5 wt % of a solvent, and water as a remaining component.

The second coating layer is formed on the metallic material where the first coating layer is formed, and formed based on the same roll coating and heat drying processes that are performed to form the first coating layer.

The manufacturing method of a fin and tube type heat exchanger in the present disclosure comprises manufacturing the metallic material, on which the first coating layer and the second coating layer are formed, into a plurality of fins, inserting a tube into the plurality of fins, and forming a heat exchanger (S30).

The metallic material where the first coating layer and the second coating layer are formed is punched and shaped into a fin, and a tube is inserted and welded into the fin, to manufacture a heat exchanger.

Figure 6:
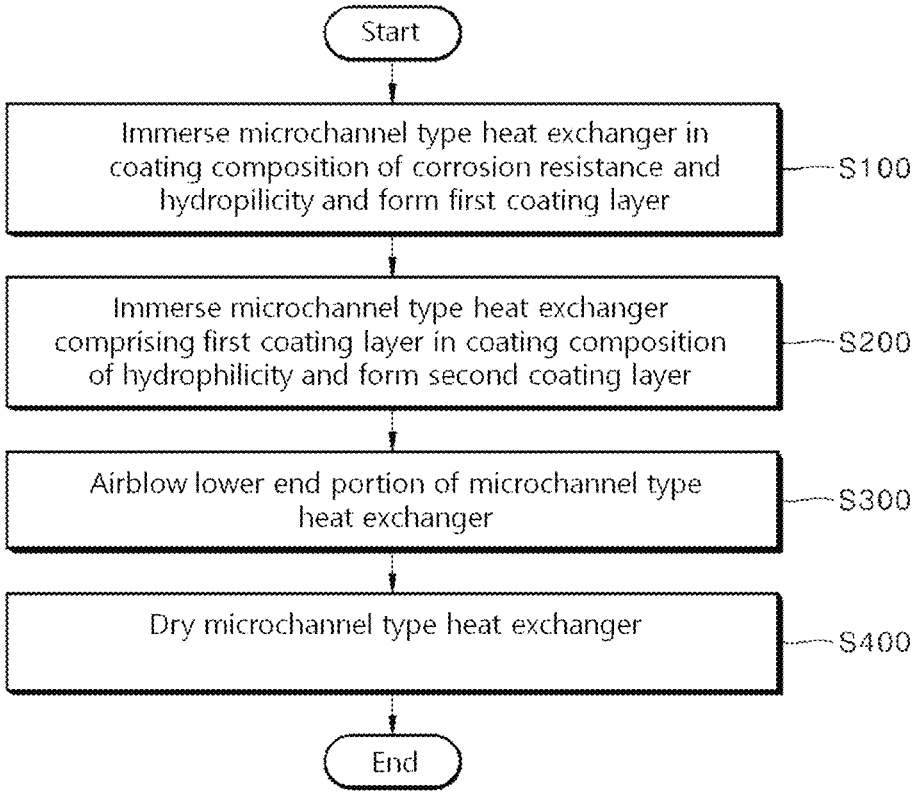
FIG. 6 is a flow chart showing a manufacturing method of a fin and tube type heat exchanger in the present disclosure.

FIG. 6 is a flow chart showing a manufacturing method of a microchannel type heat exchanger in the present disclosure.

The manufacturing method of a microchannel type heat exchanger in the present disclosure comprises: dipping a microchannel type heat exchanger in a coating composition having corrosion resistance and hydrophilicity and forming a first coating layer (S100);

immersing the microchannel type heat exchanger where the first coating layer is formed in a coating composition having hydrophilicity and forming a second coating layer (S200);

air blowing the lower end portion of the microchannel type heat exchanger (S300); and drying the microchannel type heat exchanger (S400).

The manufacturing method of a microchannel type heat exchanger in the present disclosure comprises immersing a microchannel type heat exchanger in a coating composition having corrosion resistance and hydrophilicity and forming a first coating layer (S100).

In the case of a microchannel type heat exchanger, a fin and/or a tube may be coated based on dipping, after the microchannel type heat exchanger is manufactured.

The corrosion resistant and hydrophilic coating composition comprises 10-40 wt % of a first hydrophilic resin, 1-20 wt % of a metal compound, 5-20 wt % of an amide-based cross linker, 1-15 wt % of a silane compound, and water as a remaining component.

Description of materials constituting the first coating layer is provided above and omitted hereafter.

The manufacturing method of a microchannel type heat exchanger in the present disclosure comprises immersing the microchannel type heat exchanger where the first coating layer is formed in a coating composition having hydrophilicity and forming a second coating layer (S200).

The hydrophilic coating composition comprises 1-20 wt % of a second hydrophilic resin, 1-20 wt % of a silica particle, 0.01-5 wt % of a cross linker, 0.1-5 wt % of a solvent, and water as a remaining component.

Description of materials constituting the second coating layer is provided above and omitted hereafter.

The manufacturing method of a microchannel type heat exchanger in the present disclosure comprises air blowing the lower end portion of the microchannel type heat exchanger (S300).

The air blowing process is performed to remove the coating composition in the lower end portion of the microchannel type heat exchanger, and is preferably performed at pressure of 3-10 kgf/cm$^2$. In the case where the air blowing process is performed at less than 3 kgf/cm$^2$, the coating composition in the lower end portion of the heat exchanger is not removed, and in the case where the air blowing process is performed at greater than 10 kgf/cm$^2$, the coating composition is removed excessively. Accordingly, a target amount of coating is not coated, and the corrosion resistance and hydrophilicity of the heat exchanger deteriorate.

The manufacturing method of a microchannel type heat exchanger in the present disclosure comprises drying the microchannel type heat exchanger (S400).

The drying process is performed to deposit the coating composition, formed at the microchannel type heat exchanger, reliably as a film, and performed in a drying furnace, within a drying temperature range of 240±15° C. Accordingly, a processing temperature range for forming a conventional coating film may be expanded by about 10° C., and a mid range temperature may be decreased by about 10° C. to improve processability.

The manufacturing method of a microchannel type heat exchanger in the present disclosure may further comprise degreasing and washing processes before the dipping process of the microchannel type heat exchanger.

The degreasing and washing processes may be performed to remove oil components and contaminants existing on the surface of the heat exchanger, before the dipping of the microchannel type heat exchanger, ensuring improvement in an adhesive force of the heat exchanger and the coating film.

A microchannel type heat exchanger of the present disclosure comprises: a plurality of flat tubes having a plurality of flow paths therein;

a fin connecting the flat tubes and transferring heat; and a corrosion resistant and hydrophilic coating film being formed at one or more of the flat tube and the fin, wherein a complex coating film comprises a first coating layer having corrosion resistance and hydrophilicity, and a second coating layer having hydrophilicity, the first coating layer comprises 10-40 wt % of a first hydrophilic resin, 1-20 wt % of a metal compound, 5-20 wt % of an amide-based cross linker, 1-15 wt % of a saline compound, and water as a remaining component, and the second coating layer provides a complex coating film that comprises 1-20 wt % of a second hydrophilic resin, 1-20 wt % of a silica particle, 0.01-5 wt % of a cross linker, 0.1-5 wt % of a solvent, and water as a remaining component.

The microchannel type heat exchanger in the present disclosure is specifically described hereafter and enables heat exchange between air around the flat tube and air around the fin. A plurality of microchannel type heat exchangers may Be provided to improve heat exchange efficiency.

An indoor unit and an outdoor unit of an air conditioner comprises: a cabinet assembly having an inlet into which indoor air is suctioned; and a hear exchange assembly being disposed in the cabinet assembly, and enabling heat exchange between the suctioned indoor air and refrigerants, wherein the heat exchange assembly comprises a first microchannel type heat exchanger, a second microchannel type heat exchanger being stacked on the first heat exchanger, and a support being disposed between the first heat exchanger and the second heat exchanger, integrally coupled the first heat exchanger and the second heat exchanger and supporting the second heat exchanger, the heat exchanger comprises a complex coating film being formed at one or more of the flat tube and the fin of the first heat exchanger or the second heat exchanger, the complex coating film comprises a first coating layer having corrosion resistance and hydrophilicity, and a second coating film having hydrophilicity, the first coating layer comprises 10-40 wt % of a first hydrophilic resin, 1-20 wt % of a metal compound, 5-20 wt % of an amide-based cross linker, 1-15 wt % of a saline compound, and water as a remaining component, and the second coating layer provides a complex coating film that comprises 1-20 wt % of a second hydrophilic resin, 1-20 wt % of a silica particle, 0.01-5 wt % of a cross linker, 0.1-5 wt % of a solvent, and water as a remaining component.

Figure 7:
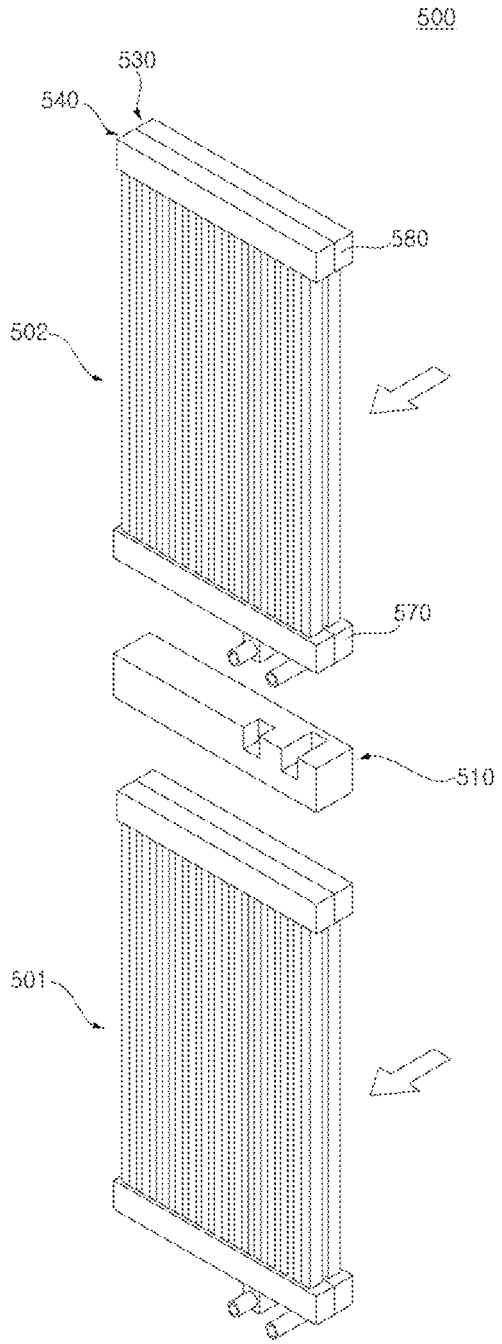
FIG. 7 is a perspective view showing a heat exchanger assembly in an indoor unit of an air conditioner in the present disclosure.

FIG. 7 is a perspective view showing a heat exchanger assembly in an indoor unit of an air conditioner in the present disclosure.

In the case of a heat exchange assembly 500 in the indoor unit of the air conditioner according to the present disclosure, a first microchannel type heat exchanger 501 and a second microchannel type heat exchanger 502 are separately manufacture, are stacked vertically and operate as one heat exchanger.

In the heat exchange assembly 500, one of the first microchannel type heat exchanger 501 and the second microchannel type heat exchanger 502 forms a parallel flow, and the other forms a counter flow.

Since a large surface inlet formed on the rear surface of the heat exchange assembly 500 is covered by the first microchannel type heat exchanger 501 and the second microchannel type heat exchanger 502 that are stacked, the microchannel type heat exchangers do not need to be replaced, even if the surface area of the inlet expands.

In the case where two heat exchangers having a height greater than a width are stacked for the heat exchange assembly 500, a reliable coupling structure is provided through a supporter 510, and a pipe connection part is inserted into the supporter such that the pipe connection part is protected.

Two heat exchangers having a height greater than a width are stacked for the heat exchange assembly 500, to deal with pressure imbalance between refrigerants at the upper side and refrigerants at the lower side.

The first heat exchanger 501 and the second heat exchanger 502 may have the same structure.

Figure 8:
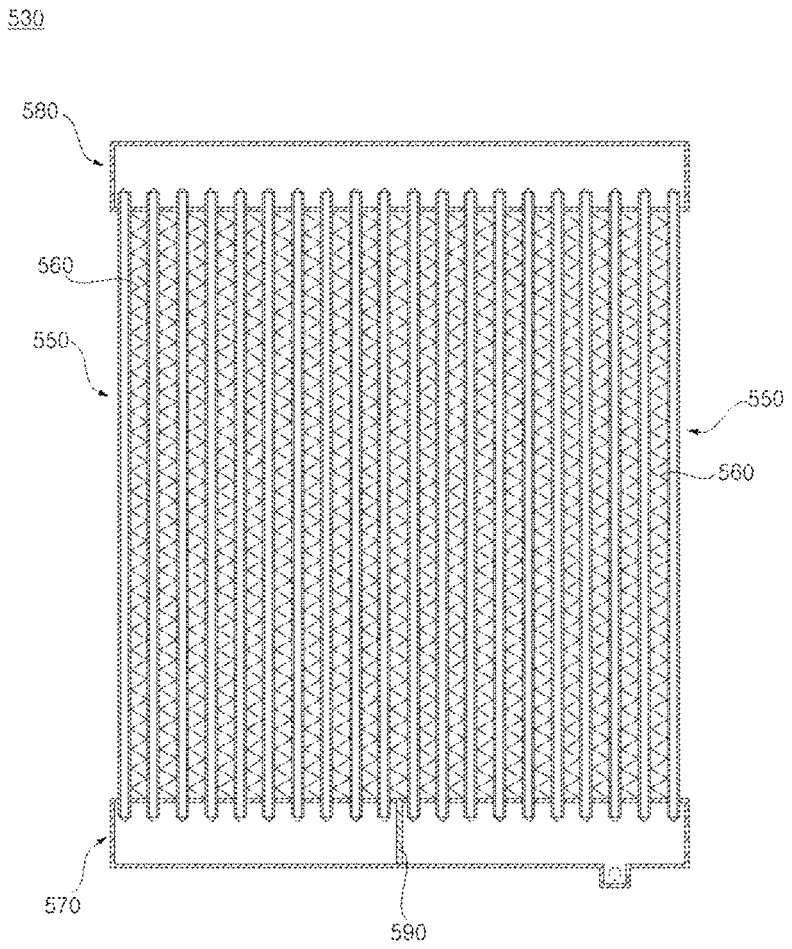
FIG. 8 is a cross-sectional view showing a microchannel type heat exchanger in the present disclosure.

FIG. 8 is a cross-sectional view showing a microchannel type heat exchanger in the present disclosure. The structure of the first heat exchanger 501 is specifically described as an example.

The first heat exchanger 501 comprises a first heat exchange part 530 exchanging heat with air, and a second heat exchange part 540 being stacked at the first heat exchange part 530 in a front-rear direction and exchanging heat with air. The first heat exchange part 530 and the second heat exchange part 540 are integrally manufactured in a furnace.

The first heat exchange part 530 and the second heat exchange part 540 are microchannel type heat exchangers. The first heat exchange part 530 and the second heat exchange part 540 are made of aluminum.

The first heat exchange part 530 comprises a plurality of flat tubes 550 having a plurality of flow paths therein, a fin 560 connecting the flat tubes 550 and transferring heat, a first lower header 570 being coupled to one side of the plurality of flat tubes 550, communicating with one side of the plurality of flat tubes 550 and allowing refrigerants to flow, a first upper header 580 being coupled to the other side of the plurality of flat tubes 550, communicating with the other side of the plurality of flat tubes 550 and allowing refrigerants to flow, and a baffle 590 being formed at least any one of the first lower header 270 or the first upper header 580 and partitioning the inside of the first lower header 570 to prevent refrigerants from flowing.

The flat tube 550 has a flow path therein, which is elongated in the lengthwise direction of the flat tube 550 and in which refrigerants flow. The flat tube 550 is disposed perpendicularly, the plurality of flat tubes 550 is stacked in a left-right direction, and the flat tube 550 has a plurality of flow paths therein. Refrigerants flow along the lengthwise direction of the flat tube 550.

The left side of the flat tube 550 is inserted into and communicates with the first lower header 570. The right side of the flat tube 550 is inserted into and communicates with the first upper header 580.

The fin 560 bends and connects the two stacked flat tubes 550 to conduct heat.

A low path of air passing through the microchannel type heat exchanger 501 is described as follows.

Air having passed through an indoor fan may move to the heat exchanger 510. Specifically, the air having passed through the indoor fan may move to spaces formed among the plurality of fins 560. The air having moved to the spaces may exchange heat with refrigerants moving along the flat tubes 550.

In the winter, frost may be made on the outer surface of the plurality of fins 560. That is, refrigerants moving along the flat tubes 550 and air being moved by the indoor fan may have a different temperature. Additionally, a difference between the temperature of the refrigerants and the temperature of the air may increase further in the winter.

To prevent this from happening, a complex coating film of the present disclosure may be formed on the fin 560 and the flat tubes 550. The complex coating film may surround the outer surfaces of the fin 560 and the flat tubes 550 entirely.

Hereafter, complex coating films in embodiments is described specifically. The embodiments are provided as examples to describe the subject matter of the present disclosure in detail. The subject matter of the present disclosure is not restricted by the embodiments.

EMBODIMENTS

Embodiments 1-6: Manufacturing of coating film

1. Degreasing and Washing Aluminum Metal

Aluminum metal was degreased at 60° C. for 30 seconds with an alkali solution, and then was washed at 50-70° C. and dried at 110° C.

The dried aluminum metal was annealed at 300° C. or less for 30 hours.

2. Formation of Corrosion Resistant and Hydrophilic Coating Layer

An acrylic resin, a metal compound comprising Cr and Zr, a silane compound, an amide-based cross linker and water were mixed to manufacture a corrosion resistant and hydrophilic coating composition.

The corrosion resistant and hydrophilic coating composition was coated on the surface of the aluminum metal, based on roll coating, and then dried at 230° C., to form a first coating layer.

3. Formation of Hydrophilic Coating Layer

A hydrophilic resin, a silica particle, a cross linker, a solvent and water were mixed to manufacture a hydrophilic coating composition.

The hydrophilic coating composition was coated on the corrosion resistant and hydrophilic coating layer, based on roll coating, and then dried at 230° C., to form a second coating layer.

Table 1 hereafter shows the content of components included in the coating compositions of embodiments 1 to 6.

TABLE 1

| | Component (wt %) | | Embodiment 1 | Embodiment 2 | Embodiment 3 | Embodiment 4 | Embodiment 5 | Embodiment 6 |
|---|---|---|---|---|---|---|---|---|
| Complex coating layer | First hydrophilic resin | | 15 | 20 | 25 | 30 | 35 | 40 |
| | Metal compound | Chromium compound | 2 | 4 | 5 | 6 | 8 | 10 |
| | | Zirconium compound | 1 | 3 | 5 | 7 | 9 | 10 |
| | Amide-based cross linker | | 5 | 8 | 11 | 13 | 15 | 20 |
| | Silane compound | Epoxy group | 1.5 | 2.5 | 3.5 | 4.5 | 5.5 | 7 |
| | | Amino group | 1.5 | 2.5 | 3.5 | 4.5 | 5.5 | 7 |
| | Amide-based cross linker | | 5 | 8 | 11 | 13 | 15 | 20 |
| | Water | | Remaining portion | Remaining portion | Remaining portion | Remaining portion | Remaining portion | Remaining portion |
| Hydrophilic layer | Second hydrophilic resin | | 2 | 4 | 7 | 12 | 15 | 20 |
| | Silica particle | | 1 | 5 | 10 | 13 | 17 | 20 |
| | Coupling cross linker | | 0.01 | 0.1 | 0.5 | 1 | 3 | 5 |
| | Solvent | | 0.1 | 0.5 | 1 | 2 | 3 | 5 |
| | Water | | Remaining portion | Remaining portion | Remaining portion | Remaining portion | Remaining portion | Remaining portion |

Comparative Example 1

A hydrophilic resin was put into ion exchanged water at room temperature, an amide-based resin was put into the preparation liquid that is being stirred, a zirconium hydrofluoric acid, chromium nitrate and sodium meta vanadate were consecutively put into the preparation liquid, an epoxy silane compound catalyst was put into the preparation liquid, and then an amide silane compound catalyst was put into the preparation liquid, to prepare a coating liquid.

The coating liquid was applied on an aluminum plate at 1 micron and heated for 30 seconds with hot air of 240° C., to manufacture a coating layer.

Comparative Example 2

In 100 parts by weight of an acrylic resin aqueous dispersion liquid, 400 parts by weight of a colloidal silica aqueous dispersion liquid, 11.4 parts by weight of methyl etherficated melamine resin solution, and water were added to obtain a composition for hydrophilization that has about 20% of solid content.

The composition for hydrophilization was degreased with an aqueous solution where an alkali degreasing agent is dissolved at concentration of 2%, applied to an aluminum plate treated with a cromate agent to form a dry film at 1 micron, and heated for 30 seconds with hot air of 240° C., to manufacture a coating layer.

EXPERIMENTAL EXAMPLE

Experimental Example 1: Analysis of Exterior and Surface of Complex Coating Film The exterior and surface of the complex coating film of the present disclosure were analyzed, and results of the analysis are shown in FIG. 9.

Figure 9:
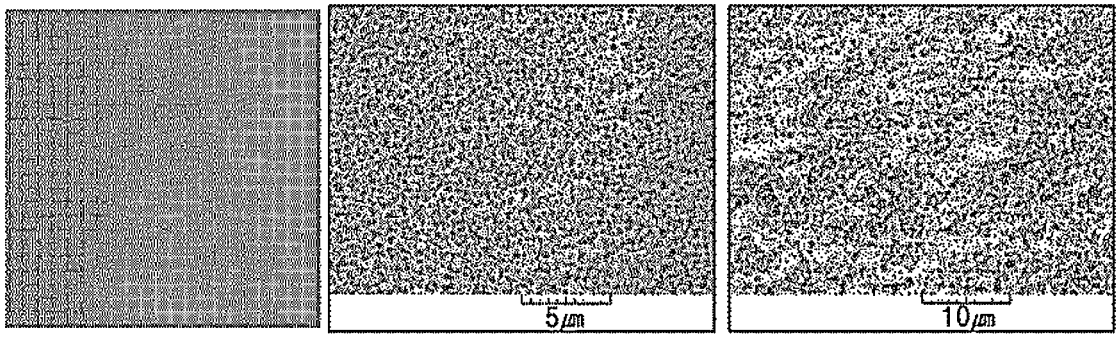
FIG. 9 (region a) shows the exterior of an aluminum metal material after the formation of a complex coating film of the present disclosure on the surface of the aluminum metal material, FIG. 9 (region b) shows an SEM photo of an aluminum metal material after the formation of a first coating layer of a complex coating film of the present disclosure on the aluminum metal material, and FIG. 9 (region c) shows an SEM photo of an aluminum metal material after the formation of a complex coating film of the present disclosure on the aluminum metal material.

FIG. 9 (region a) shows the exterior of an aluminum metal material after the formation of a complex coating film of the present disclosure on the surface of the aluminum metal material, FIG. 9 (region b) shows an SEM photo of an aluminum metal material after the formation of a first coating layer of a complex coating film of the present disclosure, exhibiting corrosion resistance and hydrophilicity, on the aluminum metal material, and FIG. 9 (region c) shows an SEM photo of an aluminum metal material after the formation of a complex coating film of the present disclosure on the aluminum metal material.

As shown in FIG. 9, the exterior of the complex coating film of the present disclosure is in shades of gray color, and the complex coating film is formed uniformly. As shown in the SEM photo, a porous structure of the complex coating film having corrosion resistance and hydrophilicity and an irregular structure of s silica particle of the second coating layer having hydrophilicity of the complex coating film are mixed. In the case where an irregular structure is formed on the surface and the roughness of the surface increases, hydrophilic performance is expected to improve.

Experimental Example 2: Analysis of Hydrophilicity of Complex Coating Film

The hydrophilicity of the complex coating film of the present disclosure was analyzed, and results of the analysis are shown in FIG. 9 and table 2 hereafter.

Figure 10:
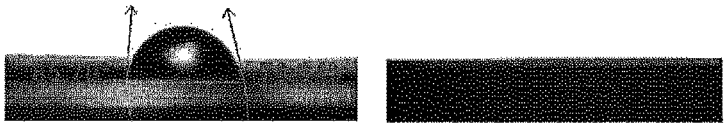
FIG. 10 is a photo showing a water contact angle before (a) and after (b) the formation of a complex coating film of the present disclosure on the surface of aluminum.

FIG. 10 is a photo showing a water contact angle before and after the formation of a complex coating film of the present disclosure on the surface of aluminum, and to measure the water contact angle, 10 μℓ of distilled water was dropped, and then a surface contact angle was measured.

The water contact angle was 81.17° before the complex coating film of the present disclosure was formed on the surface of aluminum, decreasing water spreadability and a diameter of a water spread. In the case where the complex coating film of the present disclosure is formed on the surface of aluminum, hydrophilicity improves, and water spreadability increases. Accordingly, when distilled water is dropped, since water spreadability increases, the contact angle is 5° or less, and a diameter of a water spread increases.

Additionally, the hydrophilic performance of the complex coating film of the present disclosure was evaluated, and results of the evaluation is shown in table 2.

A coating amount was analyzed by calculating an amount of coating coated per sample area, based on a difference in weight before and after coating.

To measure the hydrophilicity of an original plate, 10 μℓ of distilled water was dropped, and then a diameter of a water spread was measured, as soon as the complex coating film was formed.

Under the assumption that the complex coating film was dipped in distilled water for 10 minutes and then dried for 10 minutes in one cycle, ten cycles were performed, 10 μℓ of distilled water was dropped to the surface of a coating film, and then a diameter of a water spread was measured with a vernier caliper, to analyze initial hydrophilicity.

Under the assumption that the complex coating film was dipped in distilled water for 10 minutes and then dried for 10 minutes in one cycle, 300 cycles were performed, 10 μℓ of distilled water was dropped to the surface of a coating film, and then a diameter of a water spread was measured with a vernier caliper, to analyze durable hydrophilicity.

Under the assumption that the complex coating film was dipped in distilled water for 10 minutes and then dried for 10 minutes in one cycle, 1000 cycles were performed, 10 μℓ of distilled water was dropped to the surface of a coating film, and then a diameter of a water spread was measured with a vernier caliper, to analyze long-lasting hydrophilicity.

TABLE 2

| Category | | Comparative example 1 | Complex coating film of the present disclosure | | |
|---|---|---|---|---|---|
| Coating amount | First coating layer | 0.8 g/m$^2$ | 0.5 g/m$^2$ | 1.0 g/m$^2$ | 1.5 g/m$^2$ |
| | Second coating layer | — | 0.5 g/m$^2$ | 1.0 g/m$^2$ | 1.5 g/m$^2$ |
| Hydrophilicity | Hydrophilicity of original plate | ○ | ◎ | ◎ | ◎ |
| | Initial hydrophilicity | Δ | ◎ | ◎ | ◎ |
| | Durable hydrophilicity | X | ○ | ○ | ○ |
| | Long-lasting hydrophilicity | X | Δ | Δ | Δ |

In table 2, ◎ denotes a water spread diameter of 15 mm or greater, ○ denotes a water spread diameter of 10-15 mm, Δ denotes a water spread diameter of 8-10 mm, and X denotes a water spread diameter of 8 mm or less.

Table 2 shows that unlike comparative example 1, the original plate hydrophilicity, the initial hydrophilicity, the durable hydrophilicity and the long-lasting hydrophilicity of the complex coating film of the present disclosure are all excellent, as a result of measurement of hydrophilicity based on a coating amount.

Experimental Example 3: Analysis of Corrosion Resistance of Coating Film Based on Experimental Period The corrosion resistance of the complex coating film of the present disclosure was analyzed based on an experimental period, and results of the analysis are shown in table 3 hereafter.

To measure the corrosion resistance of the coating film, an acetic acid salt spray test (SWAAT, ASTM G85-A3) test simulating an aquatic environment that contains an acidic component was performed, a solution was comprised of 4.2% of NaCl and 1% of $CH_3COOH$, the acidity of the solution was pH 2.8-3.0, and cycle conditions of a spray of the solution for 30 minutes (49° C.) and a wet atmosphere for one and a half hours (49° C.) were repeated.

Additionally, to analyze the corrosion resistance, an acetic acid salt spray test was performed for periods shown in table 3, and corrosion resistant performance was evaluated based on a rating number (R.N.) of the coating film.

TABLE 3

| Example | Comparative example 1 | Comparative example 2 | Complex coating film of the present disclosure | | | | | |
|---|---|---|---|---|---|---|---|---|
| Experimental period (time/hour) | 360 | 360 | 168 | 288 | 360 | 432 | 528 | 676 |
| Corrosion resistance (SWAAT 72 hr) | ○ | Δ | ◎ | ◎ | ◎ | ○ | ○ | ○ |

In table 3, ◎ denotes R.N. of 9.8 or greater, ○ denotes R.N. of 8-9.5, Δ denotes R.N. of 7-8, and X denotes R.N. of 6 or less.

Table 3 shows that the R.N. of comparative example 1 is 8.0 or less (a rate of a corroded area of 0.10% or greater and less than 0.25%), and the R.N. of comparative example 2 is 7.0, while the R.N. of the complex coating film of the present disclosure is 9.8 or greater (a rate of a corroded area of less than 0.02%) for 168-360 hours and is 8.0 or greater for 432-676 hours, in the case where a rating number is expressed based on a rate of a corroded area of the coating film.

Table 3 shows that the corrosion resistance of the complex coating film of the present disclosure is maintained for a long period of time.

Experimental 4: Analysis of Antibacterial Performance of Coating Film Based on Cycle The corrosion resistance of the coating film of the present disclosure based on a cycle was analyzed, and results of the analysis are shown in table 4 hereafter.

The coating film was accelerated through a wet/dry cycle test, and then the antibacterial performance of the coating film was tested.

The antibacterial test was performed based on the KS M ISO 22196 antibacterial test standard method, and the same number of bacteria bred/was injected in each coating film and then left for 24 hours, and the number of remaining bacteria was compared.

TABLE 4

| | Cycle | | | |
|---|---|---|---|---|
| | Initial (10 cycle) | | Long-lasting (2000 cycle) | |
| Example | Comparative example 2 | Coating film of the present disclosure | Comparative example 2 | Coating film of the present disclosure |
| Antibacterial property (%) | 99.9999 | 99.9999 | 95.0 | 96.8 |
| Number of remaining bacteria (ea/cm$^2$) | $1.1*10^6$ | $1.1*10^6$ | $4.9*10^4$ | $2.9*10^4$ |

In the case of 10 cycles, the coating film of comparative example 2 and the complex coating film of the present disclosure show the same results, i.e., an antibacterial property of 99.9% or greater. However, in the case of 2000 cycles, the long-lasting acceleration-tested coating film has a higher antibacterial property than the coating film of comparative example 2.

Specifically, in the case of long-lasting 2000 cycles, the number of remaining bacteria of the coating film of the present disclosure is 40% less than that of the coating film of comparative example 2, ensuring a high anti bacterial property.

Experimental Example 5: Analysis of Drainage of Heat Exchanger

The drainage of a heat exchanger where the complex coating film of the present disclosure is formed was analyzed based on a cycle, and results of the analysis are shown in table 11.

To test drainage, distilled water was drained from a heat exchanger, and water remaining on the surface of the heat exchanger was weighed in the case where the distilled water was sprayed to the heat exchanger and then was left perpendicularly for a certain period of time.

Water droplets spread easily on a highly hydrophilic surface and was drained gravitationally, as the distilled water contacted the surface, water remaining on the surface of the heat exchanger weighed less.

Figure 11:
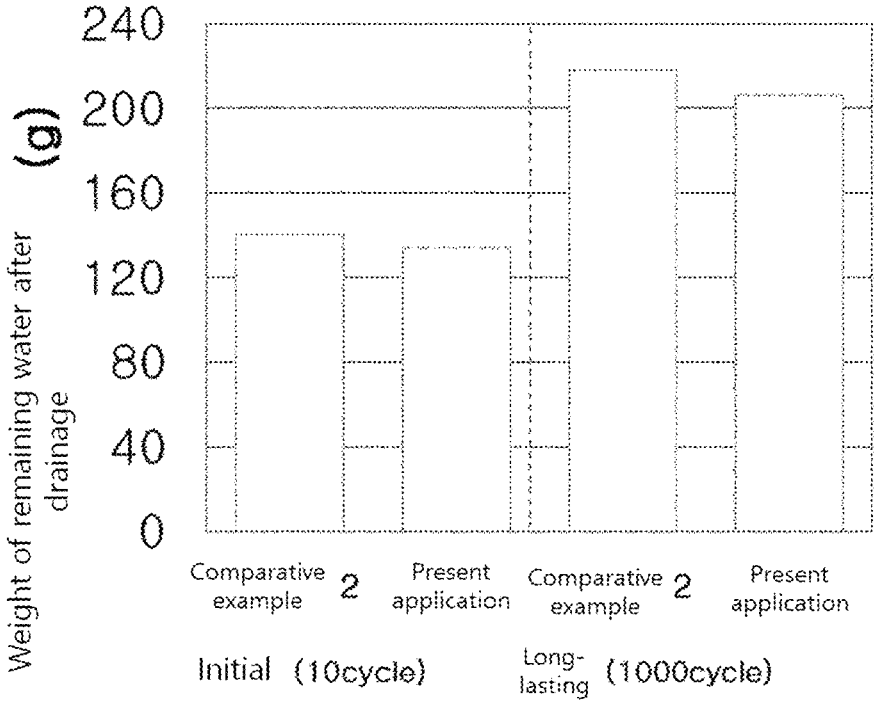
FIG. 11 is a graph showing drainage based on a cycle of a heat exchanger in which a complex coating film of the present disclosure is formed.

As illustrated in FIG. 11, the complex coating film of the present disclosure, formed at the heat exchanger, is more hydrophilic than that of comparative example 1 and comparative example 2. Accordingly, remaining water weighs less after the drainage test.

In the case of a complex coating film of the present disclosure, a hydrophilic layer is additionally stacked on a corrosion resistant and hydrophilic coating layer, to improve hydrophilicity further.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiment.

DESCRIPTION OF REFERENCE NUMERALS

1000: Complex coating film
1100: Metallic material
1200: First coating layer
1220: First hydrophilic resin
1240: Metal compound
1260: Silane compound
1280: Amide-based cross linker
1300: Second coating layer
1320: Second hydrophilic resin
1340: Silica particle
1360: Cross linker

The invention claimed is:

1. A fin and tube type heat exchanger comprising:
a plurality of refrigerant pipes; and
a fin that includes a hole through which at least one of the refrigerant pipes passes, the fin providing a space in which refrigerant moving along the refrigerant pipe and external air exchange heat,
wherein a complex coating film is formed on a surface of the fin, and
wherein the complex coating film includes a first coating layer that has corrosion resistance and hydrophilicity, and a second coating layer that is formed on the first coating layer and that has hydrophilicity,
wherein the first coating layer includes:
10-40 wt % of a first hydrophilic resin,
1-20 wt % of a metal compound,
5-20 wt % of an amide-based cross linker,
1-15 wt % of a silane compound, and
water as a remaining component, and
the second coating layer includes:
1-20 wt % of a second hydrophilic resin,
1-20 wt % of a silica particle,
0.01-5 wt % of a cross linker,
0.1-5 wt % of a solvent, and
water as a remaining component.

2. The fin and tube type heat exchanger of claim 1, wherein the first hydrophilic resin comprises at least one of an acryl group compound, an amide group compound, or a carboxyl group compound.

3. The fin and tube type heat exchanger of claim 1, wherein the metal compound comprises at least two of chromium (Cr), zirconium (Zr), or titanium (Ti).

4. The fin and tube type heat exchanger of claim 1, wherein the amide-based cross linker comprises one or more of formamide, sodiumamide, nicotinic acid amide, dimethylformamide, acetamide, acrylamide, polyacryl amide, potassiumamide, oxamide, lithiumdiethylamide, dimethylformamide, benzamide, iodoacetamide, acetamide, arylamide, phenylacetamide, cyanoacetamide, dicyanoacetamide, dimethylacetamide, diethylchloroacetamide, dimethylformamide, glycinamide, isopropylacrylamide, methaacrylamide, methylenebisacrylamide, nicotinamide, oleamide, oxamide, sulfanilamide/sulfonilamide, or thioacetamide.

5. The fin and tube type heat exchanger of claim 1, wherein the silane compound comprises an epoxy group compound.

6. The fin and tube type heat exchanger of claim 5, wherein the silane compound comprises one or more of 3-glycidoxypropyltrimethoxysilane, chlorotrimethylsilane, 4-(chloromethyl) pentyltrichlorosilane, dichlorodimethylsilane, dichloromethylsilane, dichloromethylpenylsilane, dimethyldichlorosilane, ethoxytrimethylsilane, methyltrimethoxysilane, 3-methacryloxypropyltrimethoxysilane, pentyltrichlorosilane, tetramethylsilane, vinyltriethoxysilane, triethoxyvinylsilane, vinyltrimethylsilane, tetraethoxysilane, or methyltrimethoxysilane.

7. The fin and tube type heat exchanger of claim 1, wherein the second hydrophilic resin includes at least one of a hydroxyl group compound, an amide group compound, or a carboxyl group compound.

8. The fin and tube type heat exchanger of claim 1, wherein the silica particle has a size of 1-100 nm.

9. The fin and tube type heat exchanger of claim 1, wherein the cross linker includes a metal coupling cross linker.

10. The fin and tube type heat exchanger of claim 1, wherein the solvent comprises one or more of methanol, ethanol, n-propanol, isopropanol, n-butanol, isobutanol, methoxy methanol, ethoxy methanol, methoxy propanol, ethoxy propanol, or diacetone alcohol.

11. The fin and tube type heat exchanger of claim 1, wherein a coating amount of at least one of the first coating layer or the second coating layer is 0.50-1.50 g/m$^2$.

12. A manufacturing method of a fin and tube type heat exchanger, the manufacturing method comprising:
performing roll coating and heat drying on a metallic material to form a first coating layer;
performing roll coating and heat drying on the first coating layer to form a second coating layer; and
manufacturing the metallic material on which the first coating layer and the second coating layer are formed into a plurality of fins, and inserting a tube into at least one of the plurality of fins,
wherein the first coating layer includes:
10-40 wt % of a first hydrophilic resin,
1-20 wt % of a metal compound,
5-20 wt % of an amide-based cross linker,
1-15 wt % of a silane compound, and
water as a remaining component, and
the second coating layer includes:
1-20 wt % of a second hydrophilic resin,
1-20 wt % of a silica particle,
0.01-5 wt % of a cross linker,
0.1-5 wt % of a solvent, and
water as a remaining component.

13. The manufacturing method of claim 12, wherein a coating amount of each of the first coating layer and the second coating layer is 0.50-1.50 g/m$^2$.

14. The manufacturing method of claim 12, wherein the heat drying to form each of the first coating layer and the second coating layer is performed at 200-400° C.

15. A manufacturing method of a microchannel type heat exchanger, the manufacturing method comprising:
dipping the microchannel type heat exchanger in a first coating composition having corrosion resistance and hydrophilicity, and forming a first coating layer;
immersing the microchannel type heat exchanger at which the first coating layer is formed in a second coating composition having hydrophilicity, and forming a second coating layer;
air blowing a lower end portion of the microchannel type heat exchanger; and
drying the microchannel type heat exchanger,
wherein the first coating composition includes:
10-40 wt % of a first hydrophilic resin,
1-20 wt % of a metal compound,
5-20 wt % of an amide based cross linker 1-15 wt % of a silane compound, and
water as a remaining component and
the second coating composition includes:
1-20 wt % of a second hydrophilic resin,
1-20 wt % of a silica particle,
0.01-5 wt % of a cross linker,
0.1-5 wt % of a solvent, and
water as a remaining component.

16. The manufacturing method of claim 15, wherein a coating amount of each of the first coating layer and the second coating layer is 0.50-1.50 g/m$^2$.

17. The manufacturing method of claim 15, wherein the air blowing is performed at pressure of 3-10 kgf/cm$^2$.

18. The manufacturing method of claim 15, wherein the drying is performed at 240±15° C.

19. The manufacturing method of claim 15, further comprising:
degreasing and washing the microchannel type heat exchanger before dipping the microchannel type heat exchanger.

20. A microchannel type heat exchanger comprising:
a plurality of flat tubes that have a plurality of flow paths therein;
a fin that is connected to at least one of the flat tubes and transfers heat therefrom; and
wherein a complex coating film is formed at one or more of the fin or at least one of the plurality of flat tubes,
wherein the complex coating film includes a first coating layer that has corrosion resistance and hydrophilicity, and a second coating layer of the complex coating film that has hydrophilicity,
wherein the first coating layer includes:
10-40 wt % of a first hydrophilic resin
1-20 wt % of a metal compound,
5-20 wt % of an amide-based cross linker,
1-15 wt % of a silane compound, and
water as a remaining component and
the second coating layer includes:
1-20 wt % of a second hydrophilic resin
1-20 wt % of a silica particle,
0.01-5 wt % of a cross linker
0.1-5 wt % of a solvent, and
water as a remaining component.

* * * * *